US005451277A

United States Patent [19]

Katzakian et al.

[11] Patent Number: 5,451,277

[45] Date of Patent: Sep. 19, 1995

[54] PREPARING SOLID ENERGETIC COMPOSITIONS FROM COATED PARTICLES AND LIQUID OXIDIZERS

[75] Inventors: Arthur Katzakian, Elk Grove; Charles Grix, Sacramento; George M. Clark, Orangevale, all of Calif.

[73] Assignee: Aerojet-General Corporation, Sacramento, Calif.

[21] Appl. No.: 697,854

[22] Filed: May 9, 1991

[51] Int. Cl.[6] ..... C06B 45/10

[52] U.S. Cl. ..... 149/19.92; 149/6; 149/7; 149/9; 149/19.91; 264/3.1

[58] Field of Search ..... 147/6, 7, 9, 19.91, 147/19.92; 264/3.1

[56] References Cited

U.S. PATENT DOCUMENTS

| | | | |
|---|---|---|---|
| 3,520,742 | 7/1970 | Witz | 149/19.91 |
| 3,537,922 | 11/1970 | Gilman et al. | 149/19.91 |
| 3,650,712 | 3/1972 | Martin et al. | 149/19.91 |
| 3,724,991 | 4/1973 | Schupp | 149/44 |
| 3,808,062 | 4/1974 | Yokegawa et al. | 149/109.6 |
| 4,038,115 | 7/1977 | Dehm | 149/7 |
| 4,154,633 | 5/1979 | Pierce | 149/19.92 |
| 4,163,681 | 8/1979 | Rothenstein et al. | 149/7 |
| 4,256,521 | 3/1981 | Scherzinger | 149/6 |
| 4,445,948 | 5/1984 | Stanton et al. | 149/19.91 |
| 4,481,371 | 11/1984 | Benziger | 149/92 |
| 4,875,949 | 10/1989 | Mishra et al. | 149/19.92 |

*Primary Examiner*—Edward A. Miller

*Attorney, Agent, or Firm*—Townsend and Townsend Khourie and Crew

[57] ABSTRACT

Solid energetic compositions are prepared from powdered solid components such as metallic aluminum fuel and liquid oxidizers by forming a coating of polyvinyl alcohol over the powdered solid by precipitation from a solution of polyvinyl acetate, and combining the coated particles with liquid oxidizer which will permeate and swell the particle coating, causing the particles to agglomerate into a solid rubbery mass.

20 Claims, No Drawings

PREPARING SOLID ENERGETIC COMPOSITIONS FROM COATED PARTICLES AND LIQUID OXIDIZERS

This invention relates to combustible or energetic compositions, and particularly to cast compositions containing a solid fuel, oxidizer and binder.

BACKGROUND OF THE INVENTION

The achievement of optimal performance in energetic compositions requires close control over the proportions of the oxidizer, binder and powdered metallic fuel or other particulate solid matter included in the composition. The attainment of high specific impulse combined with safety, reliability and favorable mechanical properties can suffer if the proportions are off, or if the composition is nonuniform. The problem becomes particularly acute when the compositions are prepared at locations close to the point of use. Solid compositions are at a disadvantage when compared to liquid or slurry compositions since the latter are much easier to mix and do not require casting or curing. Sources of error are the metering of three or more feed rates to control the proportions of all components, and the need to make a uniform mixture from components which differ in density, viscosity and other properties which tend to inhibit uniform mixing or stability.

SUMMARY OF THE INVENTION

These and other problems encountered in the preparation of cast energetic compositions are addressed by the present invention. According to this invention, a polymeric binder is formed as a solid coating over the fuel particles or other solid particulate matter. The coated particles are then combined with a liquid oxidizer by a mixing technique to form a dispersion, and the dispersion is cast in a mold or a case or chamber in which the energetic composition is ultimately to be retained. With the particles and liquid oxidizer thus combined, the liquid oxidizer is permitted to permeate the particle coating to convert the dispersion to a solid mass. The resulting cast composition may then be removed from the mold, or used as cured in the cast configuration.

The coating may be applied to the particles by precipitation of the polymer from a solution. A polyvinyl alcohol coating may be deposited on the solid particles, for example, by dispersing the particles in a solution of polyvinyl acetate and hydrolyzing the polyvinyl acetate in the solution to form insoluble polyvinyl alcohol. The solvent used will thus be one which dissolves the precursor but not the hydrolysis product.

The coated particle may be stored and shipped separately from the liquid oxidizer. With precoated particles of a known and well-controlled polymer content (ratio of polymer to metal), only one additional component is needed for the preparation of the energetic composition. With fewer components needed and fewer ratios to be controlled, the preparation is simplified considerably.

The polymer coating further offers the advantage of lowering the density of the metallic particles to a level which is close to that of the liquid oxidizer. When the particles are combined with the liquid oxidizer in a dispersion for placement in a mold or other cast configuration, this reduces or eliminates the tendency of the particles to settle or rise. For a given particle coating, therefore, a liquid oxidizer will optimally be selected which has a density approximating that of the coated particles.

The oxidizer will also be one which is absorbed by the polymer coating on contact, to cause aggregation of the particles into a rubbery or solid mass. The absorption of the oxidizer further causes swelling of the particle coating. In view of this property, an energetic composition can be formed by placing the coated particles into a mold or other cast configuration, then adding the liquid oxidizer, either from the bottom or by pouring in from the top. The particles will then swell, filling the interstitial volume between the particles, and a uniform distribution of particles, binder polymer and oxidizer is achieved without the need for mixing.

Other features and advantages of the invention will become apparent from the description which follows.

DETAILED DESCRIPTION OF THE INVENTION AND PREFERRED EMBODIMENTS

The combination of polymeric binder and liquid oxidizer will be one which produces a continuous solidified mass which can be removed from the mold while retaining its shape and consistency. The formation of such a cohesive solid mass is the result of permeation, or absorption, of the oxidizer by the binder. Preferably, the permeation causes swelling of the polymer, and hence the coated particle, as well. This further promotes agglomeration of the particles into a continuous mass, particularly when the swelling causes the particles to expand inside a confined space such as a mold.

The consistency of the product achieved by the combination of the polymeric binder and liquid oxidizer will vary from liquid solution, through high viscosity liquid solution, semi-solid, and rubbery mass, to solids of increasing rigidity and decreasing elasticity. For best handling, the agglomerated mass must be rigid enough to hold together without flowing or physical distortion. For optimal performance, however, it is important that the polymer contain a sufficient amount of permeated polymer to retain a rubbery, non-brittle consistency so that it is resistant to cracking. A nonenergetic polymer such as polyvinyl alcohol, furthermore, does not contribute energetic character to the formulation, and lowering the amount of the polymer will in many cases result in higher specific impulse. With these considerations in mind, a compromise of these properties is sought in selecting the optimal ratios for any given combination.

A variety of liquid oxidizers are capable of use in the present invention. Included among these are various inorganic oxidizers known to those skilled in the art, notably ammonium perchlorate and inorganic nitrate oxidizers such as ammonium nitrate, lower alkylammonium nitrate, lower alkylhydroxylammonium nitrate, hydroxylammonium nitrate, hydrazinium nitrate and lithium nitrate. These substances are placed in liquid forms in a variety of ways, including combining them with solvents or other materials which lower their melting point. It is preferred, however, to use inorganic nitrate oxidizers in combinations which have a eutectic behavior, producing all-liquid mixtures at temperatures in the range or vicinity of ambient temperature.

Some of these combinations are as follows:

(i) ammonium or a lower alkylammonium nitrate and hydroxylammonium nitrate;

(ii) hydrazinium nitrate and hydroxylammonium nitrate;

(iii) ammonium or a lower alkylammonium nitrate, hydrazinium nitrate and hydroxylammonium nitrate;

(iv) ammonium or a lower alkylammonium nitrate, hydrazinium nitrate and lithium nitrate; and (v) a lower alkylhydroxylammonium nitrate and hydroxylammonium nitrate.

The proportions of components used in preparing each composition will be those which lower the melting temperature to a level below about 30° C., and preferably below about 25° C., more preferably below about 20° C., and most preferably below about 10° C., so that the composition is entirely liquid over the entire range of temperatures which might be encountered during storage, handling and processing at any location or in any environment where this might be expected to take place. These proportions are readily determined by routine experimentation well within the expertise of the skilled laboratory technician.

Of the combinations listed above, those involving ammonium or a lower alkyl ammonium nitrate and hydroxylammonium nitrate are preferred. Examples of lower alkyl ammonium nitrates are methylammonium nitrate, dimethylammonium nitrate, ethylammonium nitrate, diethylammonium nitrate, and propylammonium nitrate. The proportions may vary, but best results are usually obtained with combinations in which the ammonium or lower alkyl ammonium nitrate is from about 3% to about 30%, preferably from about 5% to about 15% by weight of the combination.

With liquid oxidizers of this type in combination with polyvinyl alcohol (PVA), best results are obtained with oxidizer:PVA weight ratios of from about 3:1 to about 5:1, preferably from about 3:1 to about 4:1.

The particles coated by the polymer may be any solid particles included in the ultimate composition. Prime examples are metallic fuels; other examples are metallic oxides or other materials used as ballistic additives or stabilizing agents. Examples of metallic fuels are aluminum, zirconium, boron, bismuth and magnesium. Examples of metal oxides are aluminum oxide and chromium oxide. Powdered or particulate energetic compounds can also be coated in accordance with this invention. Examples are nitramines such as RDX (trimethylene trinitramine) and HMX (tetramethylene tetranitramine), and other solid ingredients which are not soluble in the solvent used.

The size of the particle core and the thickness of the coating will be selected on a basis of achieving a final composition of the desired performance and properties. Appropriate ranges will be the same as those used for preparation of the compositions by conventional methods. Metallic fuels, for example, will most often be used as 5- to 60-micron powders. Also with metallic fuels, best results are generally obtained when the ratio of the weight of the coating to the total weight of the coated particle is from about 0.1 to about 0.8, preferably from about 0.25 to about 0.5. The density of the coated particle is preferably from about 1.3 to about 2.5 g/cm$^3$, most preferably from about 1.5 to about 2.0 g/cm$^3$.

Deposition of the polymer coating on the particle may be achieved by conventional means. A preferred method is precipitation of the polymer from a solution. Polyvinyl alcohol (PVA) may be precipitated from a solution of polyvinyl acetate (PVAc) by inducing hydrolysis of the PVAc, provided that the solvent is one which dissolves the PVAc but not the PVA. Any solvent having this property may be used. Prime examples are lower alkyl alcohols, with methanol, ethanol and isopropanol preferred, and methanol the most preferred. Hydrolysis as well may be performed by conventional techniques, notably by the addition of a hydrolyzing agent such as sodium hydroxide or potassium hydroxide. The proportions and amounts are not critical and appropriate values will be readily apparent to the skilled chemical technician. Once the PVA has deposited on the core powder, the resulting coated particles are recovered by filtration, decantation or other similar conventional techniques, with washing and solvent evaporation as appropriate to achieve particles free of contamination by extraneous substances.

The present invention further extends to particles with polymer coatings which incorporate additional materials such as RDX and HMX mentioned above, as well as other types of additives. These additives may be incorporated into the coating by coprecipitation with the polymer from a solution, or by entrapment during the deposition of the polymer, as in the case of solid particles comparable in size or smaller than the core particles. Alternatively, the core particles themselves may be a mixture of materials, resulting in a mixture of coated particles differing in their core composition. Still further, the liquid oxidizer may be combined with further liquid ingredients which can then be solidified by various means to achieve the desired configuration of the final product. Examples are adhesives, coating materials, and film-forming materials.

The following example is offered for purposes of illustration, and is intended neither to limit nor to define the invention in any manner.

EXAMPLE

This example illustrates the preparation of a solid energetic composition by the method of the present invention.

A vessel was charged with 2 L of methanol (dried over molecular sieves) and heated to 40° C. Polyvinyl acetate (PVAc) (molecular weight 500,000, 300 g) was then added in portions with vigorous stirring, and stirring was continued until all PVAC had dissolved. Aluminum MDX-65 (260 g, 8-micron average particle size) was then added to the solution, and the resulting suspension was permitted to cool to room temperature.

A solution prepared by dissolving 3.00 g sodium hydroxide in 200 mL methanol was added to the aluminum/PVAc/methanol suspension. An additional 250 mL of methanol was used to rinse the beaker and addition funnel used to add the sodium hydroxide solution. The mixture was then stirred for an additional twenty to thirty minutes. The stirrer was then removed and the mixture was allowed to stand at room temperature. A gelatinous mass consisting of PVA-coated aluminum particles eventually formed in the mother liquor.

The gelatinous mass was removed, cut into slices and then macerated in a blender to produce a slurry. This slurry was then recombined with the mother liquor and permitted to stand overnight (16 hours).

The liquor was then decanted and the remaining particles were washed with methanol and filtered. The filtered particles were then placed in an oven at 43° C. (135° F.) and weighed periodically until the weight remained constant.

The clean, dry particles were screened to −32 mesh, and 8.2 g of the particles were combined with 11.8 g of a liquid oxidizer consisting of 10% ethylammonium nitrate, 88% hydroxylammonium nitrate and 2% stabilizers. The particles and oxidizer were combined in a beaker, where they were hand-stirred for three minutes and cast into a mold. This proportion resulted in a weight ratio of oxidizer to PVA of 3.9:1.

The pot life before gellation in the mold was 0.2 hour. Upon standing overnight, the material had cured to a rubbery form, and was determined by appropriate analytical procedures to have the following mechanical properties:

tensile strength, psi: 122
elongation at break, %: 510
initial tangent modulus, psi: 36

The density of the propellant was 1.746 g/cm$^3$, which compares with the expected value of 1.723 g/cm$^3$.

The foregoing is offered primarily for purposes of illustration. It will be recognized by those skilled in the art that variations, modifications and substitutions of the parameters of the invention such as operating conditions, materials and procedural steps may be made without departing from the spirit and scope of the invention.

What is claimed is:

1. A method for preparing a solid energetic composition containing solid particulate matter, an oxidizer and a binder for use as a propellant or explosive, said method comprising:

(a) preparing a first dispersion of said solid particulate matter in a solution of polyvinyl acetate in a solvent in which polyvinyl acetate is soluble and polyvinyl alcohol is not;

(b) adding to said dispersion a hydrolyzing agent to convert said polyvinyl acetate to polyvinyl alcohol, thereby depositing polyvinyl alcohol on said solid particulate matter to form coated particles, and recovering said coated particles from said dispersion; and (c) combining said particles thus recovered with a liquid oxidizer to form a second dispersion to permit said liquid oxidizer to permeate said polyvinyl alcohol and thereby solidify said dispersion.

2. A method in accordance with claim 1 in which said liquid oxidizer is a composition comprising one or more members selected from the group consisting of ammonium nitrate, lower alkylammonium nitrate, lower alkylhydroxylammonium nitrate, hydroxylammonium nitrate, hydrazinium nitrate and lithium nitrate selected such that the lowest temperature at which said composition is a liquid is entirely in the liquid phase is within the range of about 30° C. or below.

3. A method in accordance with claim 1 in which said liquid oxidizer is a composition selected from the group consisting of:

(i) ammonium or lower alkyl ammonium nitrate and hydroxylammonium nitrate;

(ii) hydrazinium nitrate and hydroxylammonium nitrate;

(iii) ammonium or lower alkyl ammonium nitrate, hydrazinium nitrate and hydroxylammonium nitrate;

(iv) ammonium or lower alkyl ammonium nitrate, hydrazinium nitrate and lithium nitrate; and (v) lower alkylhydroxylammonium nitrate and hydroxylammonium nitrate;

the proportion of components in each said composition selected such that the lowest temperature at which said composition is entirely in the liquid phase is within the range of about 30° C. or below.

4. A method in accordance with claim 1 in which said liquid oxidizer is a nonaqueous mixture containing ammonium or lower alkyl ammonium nitrate and hydroxylammonium nitrate, the proportion of said ammonium or lower alkyl ammonium nitrate in said mixture selected such that the lowest temperature at which said mixture is entirely in the liquid phase is within the range of about 30° C. or below.

5. A method in accordance with claim 4 in which the weight ratio of liquid oxidizer to polyvinyl alcohol in step (c) is from about 3:1 to about 5:1.

6. A method in accordance with claim 4 in which the weight ratio of liquid oxidizer to polyvinyl alcohol in step (c) is from about 3:1 to about 4:1.

7. A method in accordance with claim 1 in which the relative amounts of said polyvinyl acetate and said solid particulate matter in step (a) are selected such that the ratio of the weight of polyvinyl alcohol to the total weight of the coated particles resulting from step (b) is from about 0.1 to about 0.8.

8. A method in accordance with claim 1 in which the relative amounts of said polyvinyl acetate and said solid particulate matter in step (a) are selected such that the ratio of the weight of polyvinyl alcohol to the total weight of the coated particles resulting from step (b) is from about 0.25 to about 0.5.

9. A method in accordance with claim 1 in which the relative amounts of said polyvinyl acetate and said solid particulate matter in step (a) are selected such that the density of said coated particles resulting from step (b) is from about 1.3 to about 2.5 g/cm$^3$.

10. A method in accordance with claim 1 in which the relative amounts of said polyvinyl acetate and said solid particulate matter in step (a) are selected such that the density of said coated particles resulting from step (b) is from about 1.5 to about 2.0 g/cm$^3$.

11. A method in accordance with claim 1 in which said solvent is a lower alkyl alcohol.

12. A method in accordance with claim 1 in which said solvent is a member selected from the group consisting of methanol, ethanol and isopropanol.

13. A method in accordance with claim 1 in which said solvent is methanol.

14. A method in accordance with claim 1 in which said solid particular matter is a member selected from the group consisting of metallic fuels and metal oxides.

15. A method in accordance with claim 1 in which said solid particular matter is a metallic fuel.

16. A method in accordance with claim 1 in which said solid particular matter is powdered aluminum.

17. A method in accordance with claim 1 in which said hydrolyzing agent is a hydroxide salt soluble in said solvent.

18. A method in accordance with claim 1 in which said hydrolyzing agent is a member selected from the group consisting of sodium hydroxide and potassium hydroxide.

19. A method in accordance with claim 1 in which said solvent is methanol and said hydrolyzing agent is sodium hydroxide.

20. A method in accordance with claim 1 in which step (c) is performed in a mold.

* * * * *